US011119436B2

(12) United States Patent
Kai et al.

(10) Patent No.: US 11,119,436 B2
(45) Date of Patent: Sep. 14, 2021

(54) DRIVING DEVICE AND IMAGE FORMING APPARATUS

(71) Applicant: CANON KABUSHIKI KAISHA, Tokyo (JP)

(72) Inventors: Yusuke Kai, Kawasaki (JP); Yusuke Niikawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/919,648

(22) Filed: Jul. 2, 2020

(65) Prior Publication Data

US 2021/0003959 A1 Jan. 7, 2021

(30) Foreign Application Priority Data

Jul. 3, 2019 (JP) ..... JP2019-124665

(51) Int. Cl.
*G03G 15/00* (2006.01)

(52) U.S. Cl.
CPC ..... *G03G 15/757* (2013.01); *G03G 15/5008* (2013.01)

(58) Field of Classification Search
CPC ..... G03G 15/757; G03G 15/5008
See application file for complete search history.

(56) References Cited

U.S. PATENT DOCUMENTS

| | | | | |
|---|---|---|---|---|
| 10,107,362 | B2 | 10/2018 | Niikawa et al. | G03G 15/757 |
| 2003/0128995 | A1* | 7/2003 | Ishii | G03G 15/0194 399/49 |
| 2011/0017003 | A1 | 1/2011 | Taniguchi | |
| 2011/0268475 | A1* | 11/2011 | Birumachi | G03G 15/757 399/167 |
| 2014/0270852 | A1* | 9/2014 | Doshida | G03G 15/757 399/167 |
| 2018/0017915 | A1* | 1/2018 | Ishikawa | G03G 15/5008 |

FOREIGN PATENT DOCUMENTS

| | | | |
|---|---|---|---|
| JP | H11-146676 | A | 5/1999 |
| JP | 2011-027933 | A | 2/2011 |

* cited by examiner

*Primary Examiner* — Sandra Brase
(74) *Attorney, Agent, or Firm* — Venable LLP

(57) ABSTRACT

A driving device for driving a driven member includes a driving source; a driving gear fixed to a rotation shaft of the driving source; at least one gear for transmitting rotational motion of the driving gear to the driven member; a rotation detection gear engaged with the at least one gear; a detector for detecting rotation of the rotation detection gear; and a controller for detecting an angular speed and a rotational phase of the rotation detection gear on the basis of information from the detector and for controlling the rotational speed of the driving source such that a rotation period of the rotation detection gear is a non-integer multiple of a rotation period of the driving gear.

8 Claims, 8 Drawing Sheets

(a)

(b)

DRIVING DEVICE AND IMAGE FORMING APPARATUS

FIELD OF THE INVENTION AND RELATED ART

The present invention relates to a driving device, and an image forming apparatus having a driving device.

An image forming apparatus such as a copying machine and a printer, which employs an electrophotographic image forming method, forms an image through the following steps. First, it charges its photosensitive member, which is an image bearing member, with the use of its charging device. Then, it forms a latent image on the charged photosensitive member by scanning the charged peripheral surface of this photosensitive member with a beam of laser light emitted while being modulated with the information of an image to be formed. Then, it develops the latent image formed on the peripheral surface of the photosensitive member, into a toner image, with the use of its developing device. Then, it transfers the toner image onto recording medium. Next, it fixes the transferred image on the recording medium by heating and pressing the toner image. In the case of this type of image forming apparatus, the inconstancy in the rotational speed of the photosensitive member, which is an image bearing member, causes the image forming apparatus to output unsatisfactory images such as those which are nonuniform in density, color, etc. Thus, it is necessary to reduce the image forming apparatus in the inconstancy in the rotational speed of its photosensitive member, in order to improve the image forming apparatus in image quality.

Generally speaking, a photosensitive member such as the one described above is driven by the driving force from a motor which is the source of driving force transmitted thereto by way of a gear train. Therefore, the eccentricity of each gear of the gear train, "face angle error" which occur while the gear train is assembled, etc., are some of the main causes of the inconstancy in the rotational speed of the photosensitive member. As one of the means for preventing an electrophotographic image forming apparatus from suffering from the inconstancy in the rotational speed of its photosensitive member, the following method for controlling a photosensitive member in rotational speed has been known.

In the case of the method disclosed in Patent Document 1 (Japanese Laid-open Patent Application No. H11-146676, the rotational axle of the driving force source is provided with a rotary encoder, and the difference in frequency between the speed pulse train detected by the rotary encoder, which is equivalent to the rotational speed of the driving force source, and the referential pulse train is obtained. Further, the movable portion, which is the target of control, is provided with a phase sensor, and the difference in phase between the phase pulse of the movable portion detected by the phase sensor, and referential pulse, is detected. Then, the driving force source is increased or decreased in rotational speed, based on the detected differences in frequency and phase, to reduce the object of control, in the inconstancy in rotational speed.

In the case of the method disclosed in Patent Document 2 (Japanese Laid-open Patent Application No. 2011-27933), the image forming apparatus is provided with a photosensitive member gear, and a pair of idler gears. The photosensitive member gear is fixed to the rotational axle of the photosensitive member which is a member to be driven by the force from the driving force source. The pair of idler gears are rotated by being in mesh with the photosensitive member gear. Further, there is provided between the pair of idler gears, a pressing means for pressing one of the pair of idler gears in one direction, and the other in the other direction, to prevent the backlashing between the pair of idler gear. Moreover, a flag is fixed to one of the idler gears, and the passing of this flag is detected by a flag detecting portion to detect the inconstancy in the rotational speed of the photosensitive member. That is, the inconstancy in the rotational speed of the photosensitive member is indirectly detected by way of the idler gears, to reduce the image forming apparatus in the inconstancy in the rotational speed of its photosensitive member.

In the case of an image forming apparatus structured so that the shaft of its driving force source is provided with a gear through which the driving force is transmitted to its photosensitive member, or the object to be driven, and the rotational speed of the shaft of the driving force source is detected to control the driving force source in rotational speed as described in Patent Document 1, the lateral shaking of the shaft of the driving force source in the direction perpendicular to the shaft, and the fluctuation in the rotational speed of the driving force source, which is attributable to the eccentricity of the driving gear, periodically occur in synchronism with the rotation of the shaft. However, this type of inconstancy in the rotational speed of the driving gear cannot be detected with the use of the structural arrangement disclosed in Patent Document 1. Therefore, even if the driving force source is controlled (increased or decreased) in rotational speed, the photosensitive member, which is the object to be controlled in rotational speed, remains inconstant in rotational speed due to the lateral vibration of the shaft of the driving force source, and also, the eccentricity of the driving gear.

Further, in the case of an image forming apparatus structured so that the idler gear, which is in mesh with the photosensitive member gear and is rotated by the photosensitive member gear, is measured in rotational speed, and the driving force source is controlled (increased or decreased) in rotational speed, based on the detected rotational speed of the idler gear, to reduce the photosensitive member in the inconstancy in its rotational speed, as described in Patent Document 2, the photosensitive member periodically fluctuates in rotational speed in synchronism with the rotation of the idler gear, due to the eccentricity of the idler gear. However, this type of inconstancy in the rotational speed of the photosensitive member cannot be detected with the use of the structural arrangement disclosed in Patent Document 2. Therefore, the photosensitive member is made to fluctuate in rotational speed by the eccentricity of the idler gear which is measured in rotational speed.

SUMMARY OF THE INVENTION

Thus, the primary object of the present invention is to reduce an image forming apparatus in the effect of the lateral shake of the shaft of the driving force source, and also, the effect of the eccentricity of gears, in order to reduce the object to be rotated, in the inconstancy in its rotational speed.

According to an aspect of the present invention, there is provided a driving device for driving a driven member, said driving device comprising a driving source; a driving gear fixed to a rotation shaft of said driving source; at least one gear configured to transmit rotational motion of said driving gear to the driven member; a rotation detection gear engaged with said at least one gear; a detector configured to detect rotation of said rotation detection gear; and a controller configured to detect an angular speed and a rotational phase of said rotation detection gear on the basis of information from said detector and to control the rotational speed of said driving source such that a rotation period of said rotation detection gear is a non-integer multiple of a rotation period of said driving gear.

Further features of the present invention will become apparent from the following description of exemplary embodiments with reference to the attached drawings.

Figure 2:
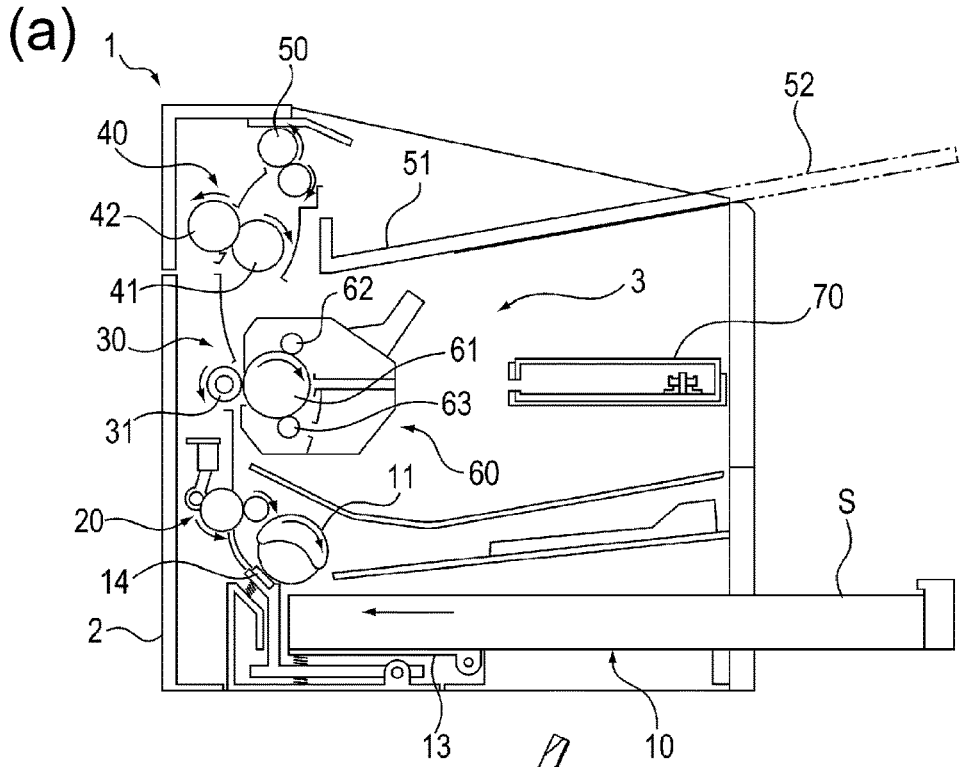
Figure 2:
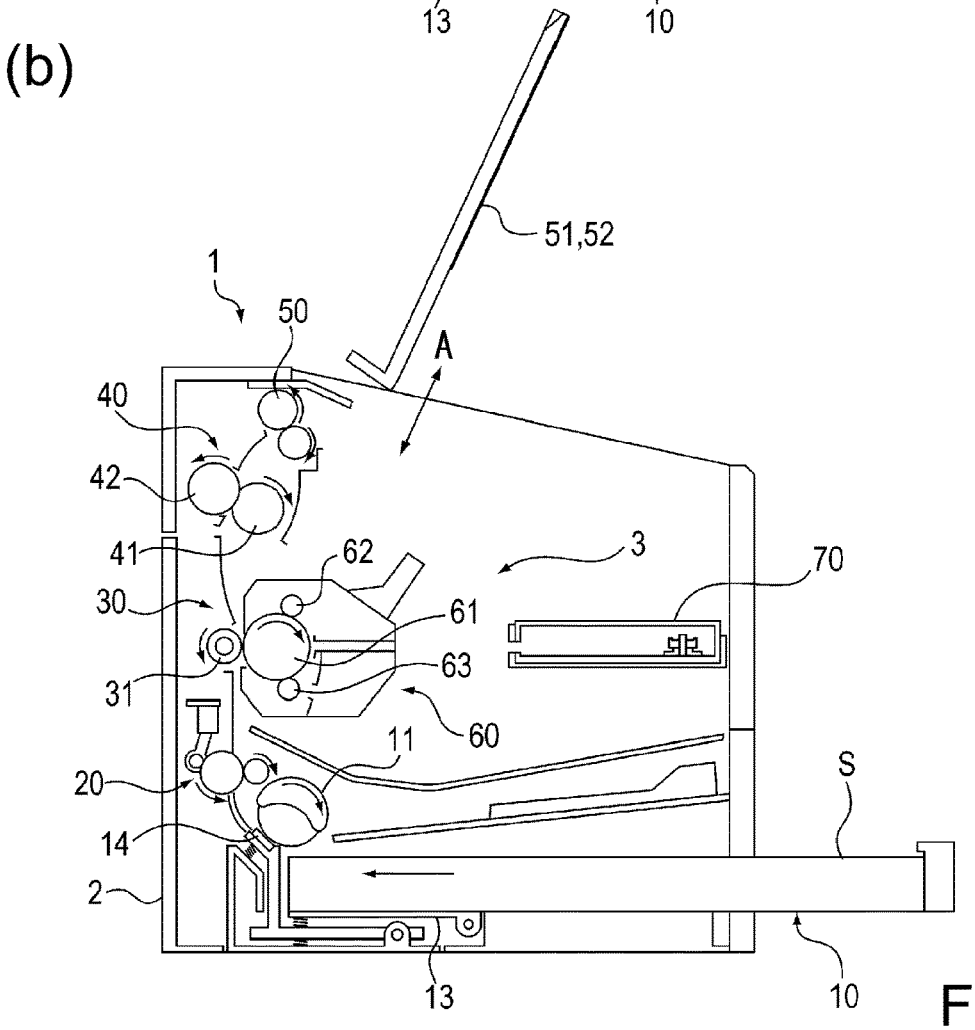

Parts (a) and (b) of FIG. 2 are schematic sectional views of the image forming apparatus in the first embodiment.

Figure 3:
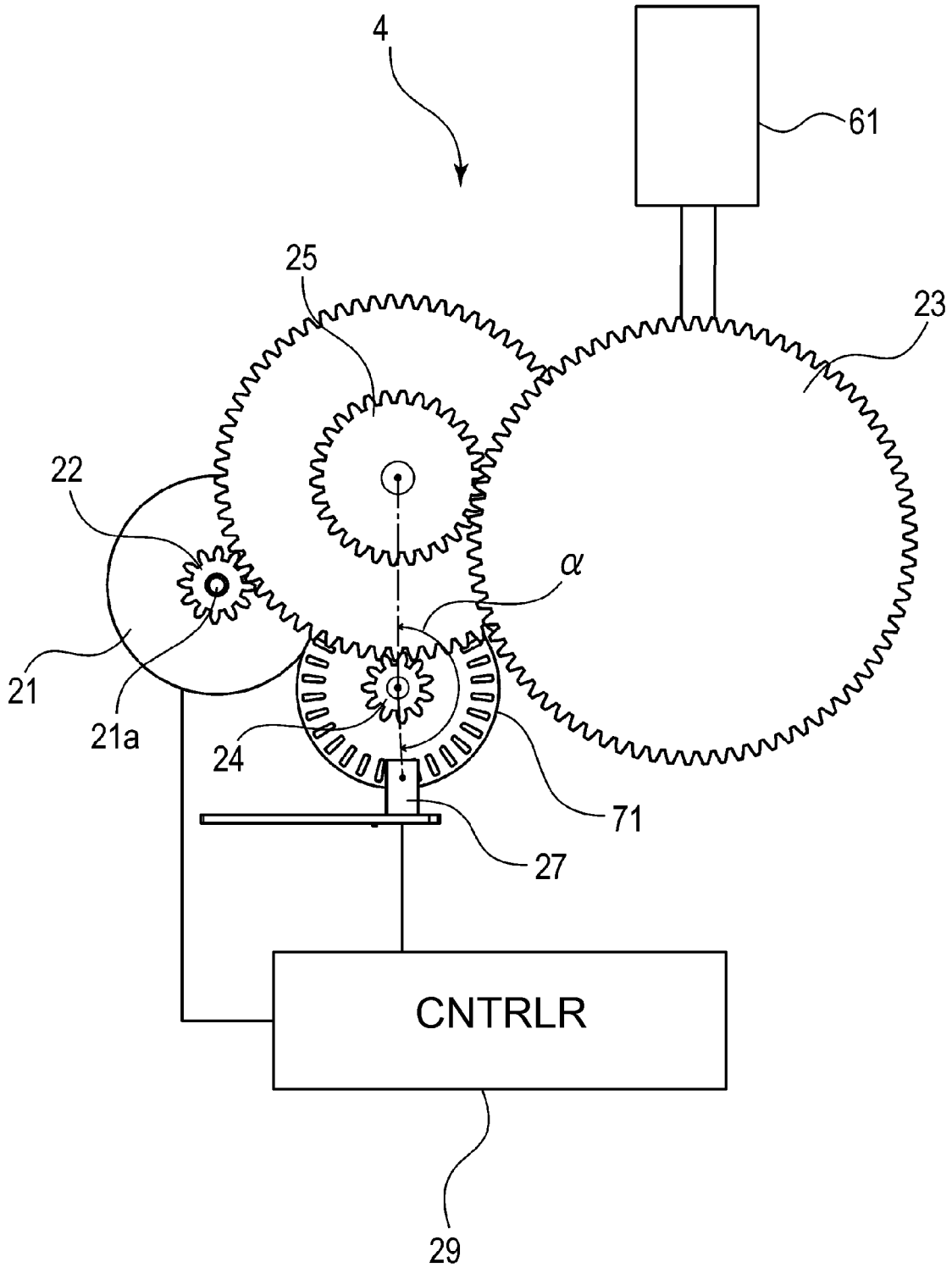

FIG. 3 is a drawing of the driving device of the image forming apparatus in the second embodiment of the present invention; it shows the structure of the driving device.

Figure 4:
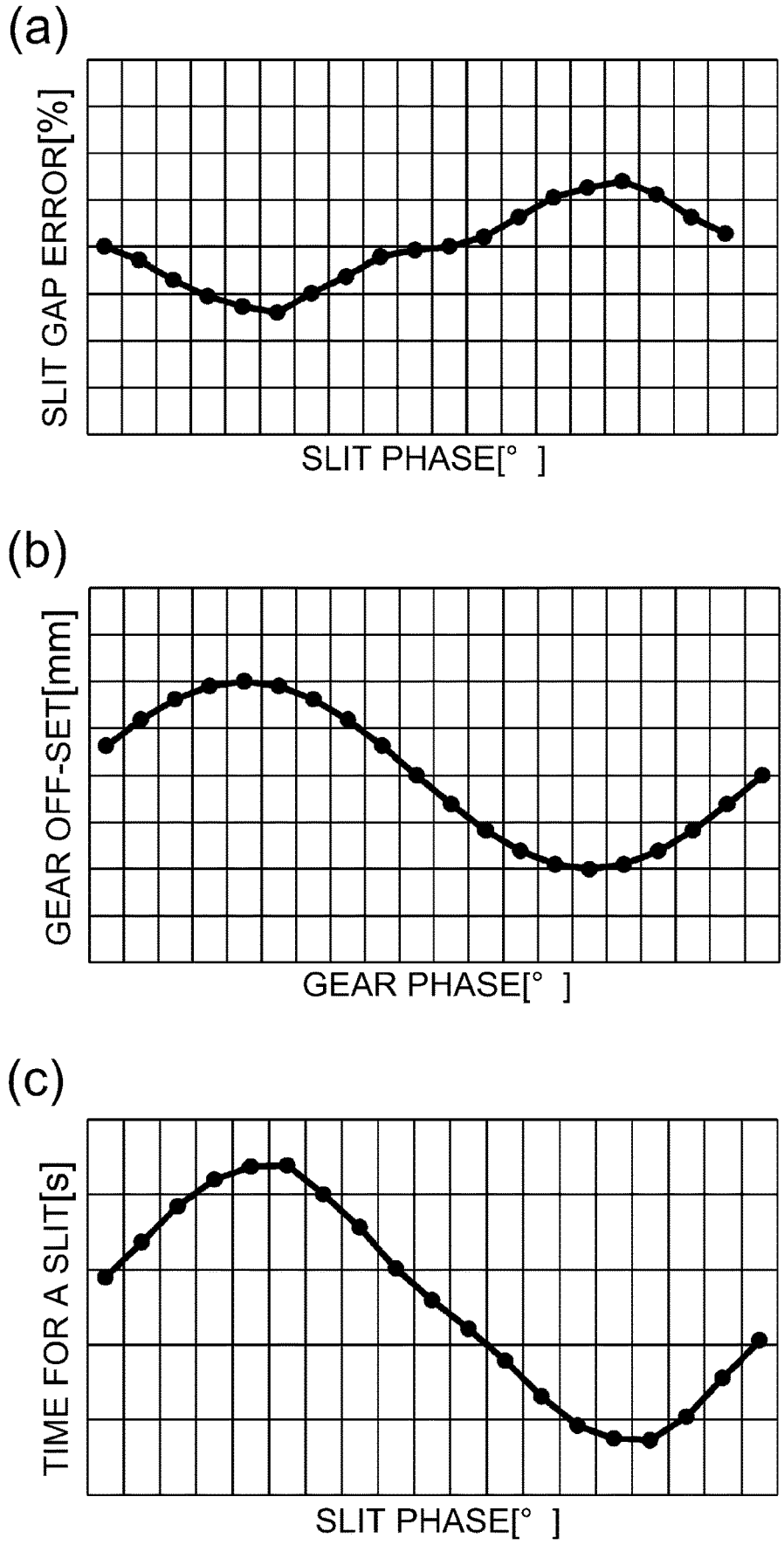

Parts (a), (b) and (c) of FIG. 4 are graphs which show the results of the detection by the detecting means when the code wheel and code wheel gear are offset in phase from each other by a half a rotation, in the second embodiment.

Figure 5:
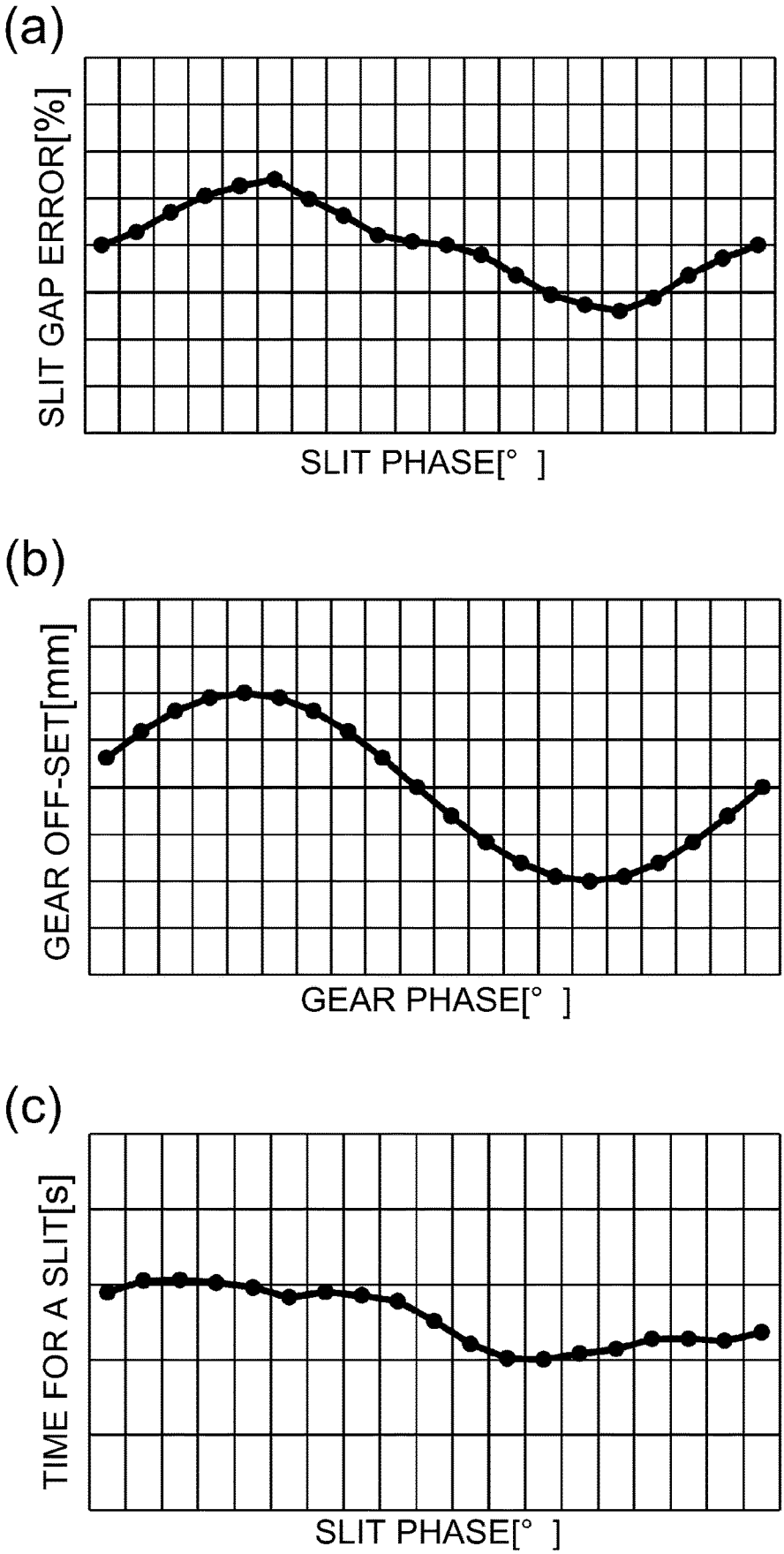

Parts (a), (b) and (c) of FIG. 5 are graphs which show the result of the detection by the detecting means when the code wheel and code wheel gear are the same in phase, in the second embodiment.

Figure 6:
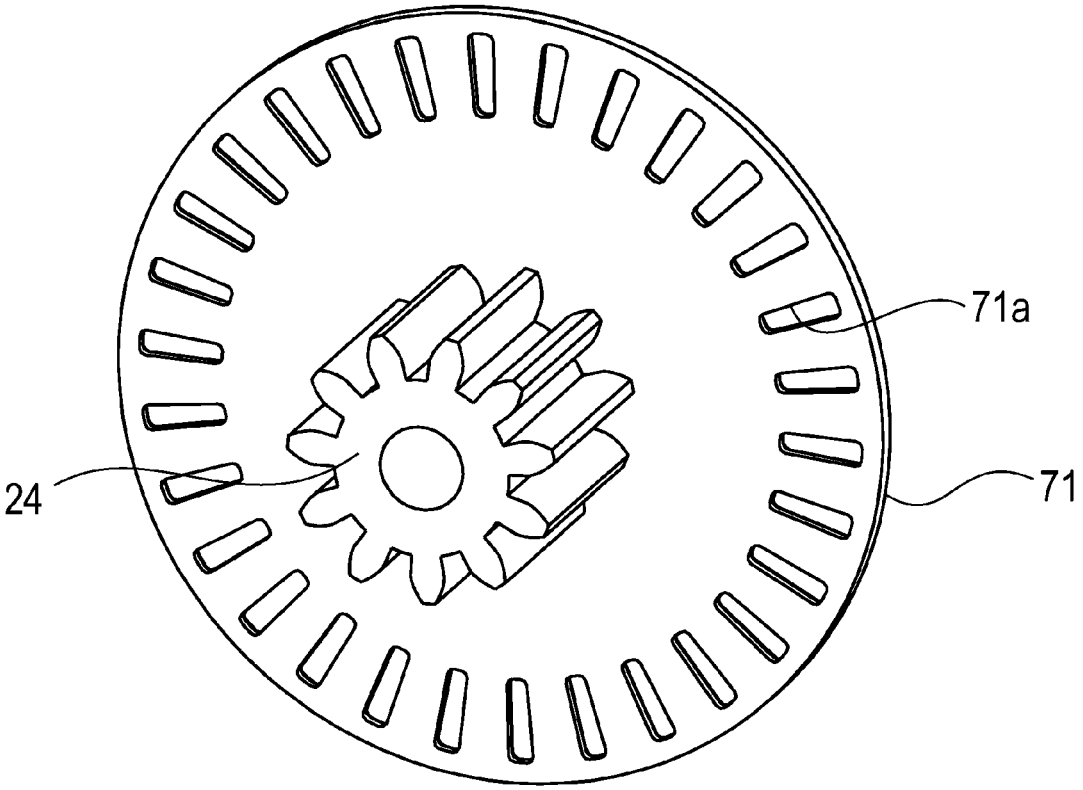

FIG. 6 is a drawing of a combination of the code wheel and rotation speed detection gear, in the second embodiment, in a case where the code wheel and rotation detection gear were integrally molded.

Figure 7:
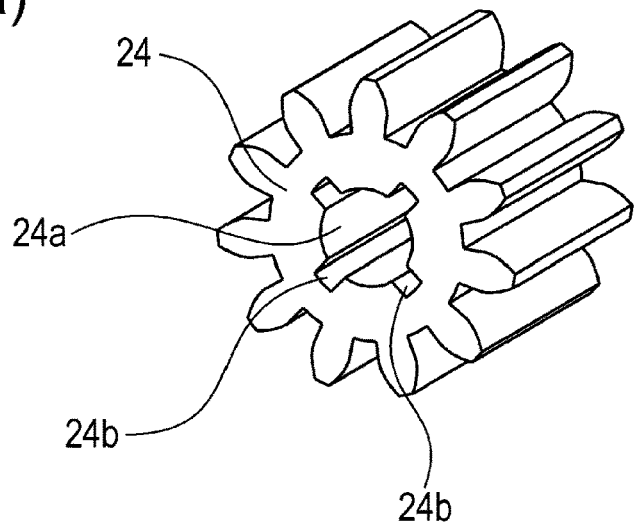
Figure 7:
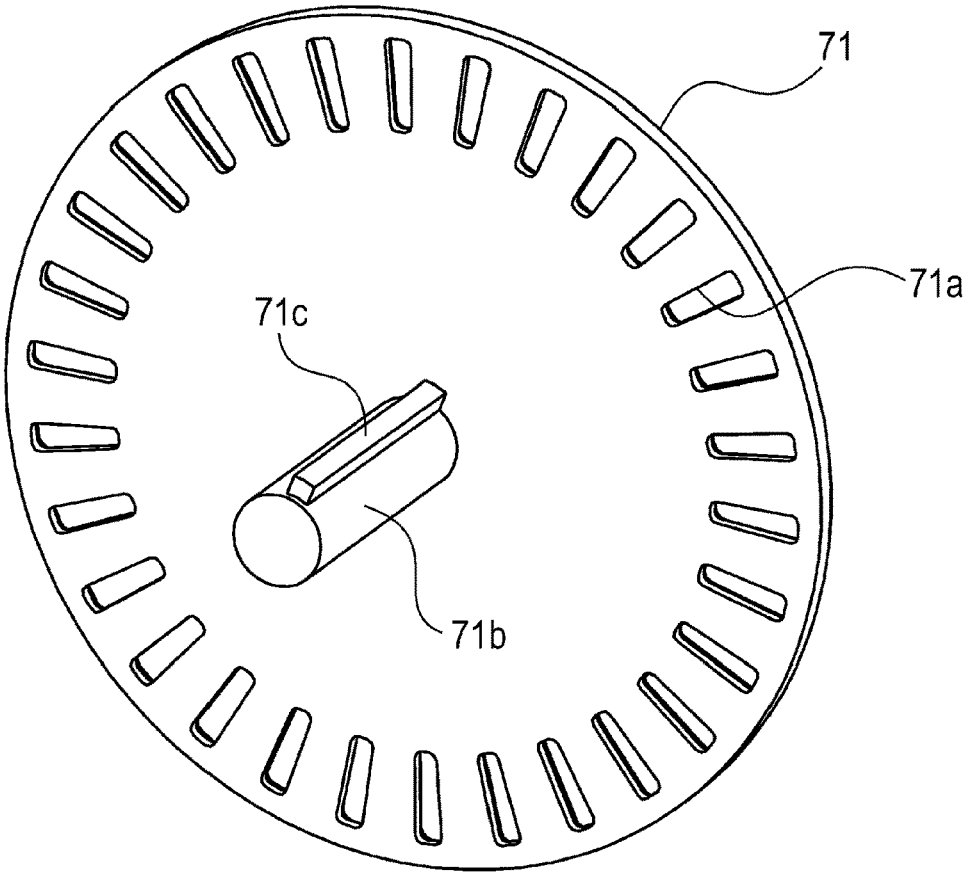

Parts (a) and (b) of FIG. 7 are drawing of the code wheel and rotation detection gear, in the second embodiment, in a case where the code wheel and code wheel gear 24 were separately molded.

Figure 8:
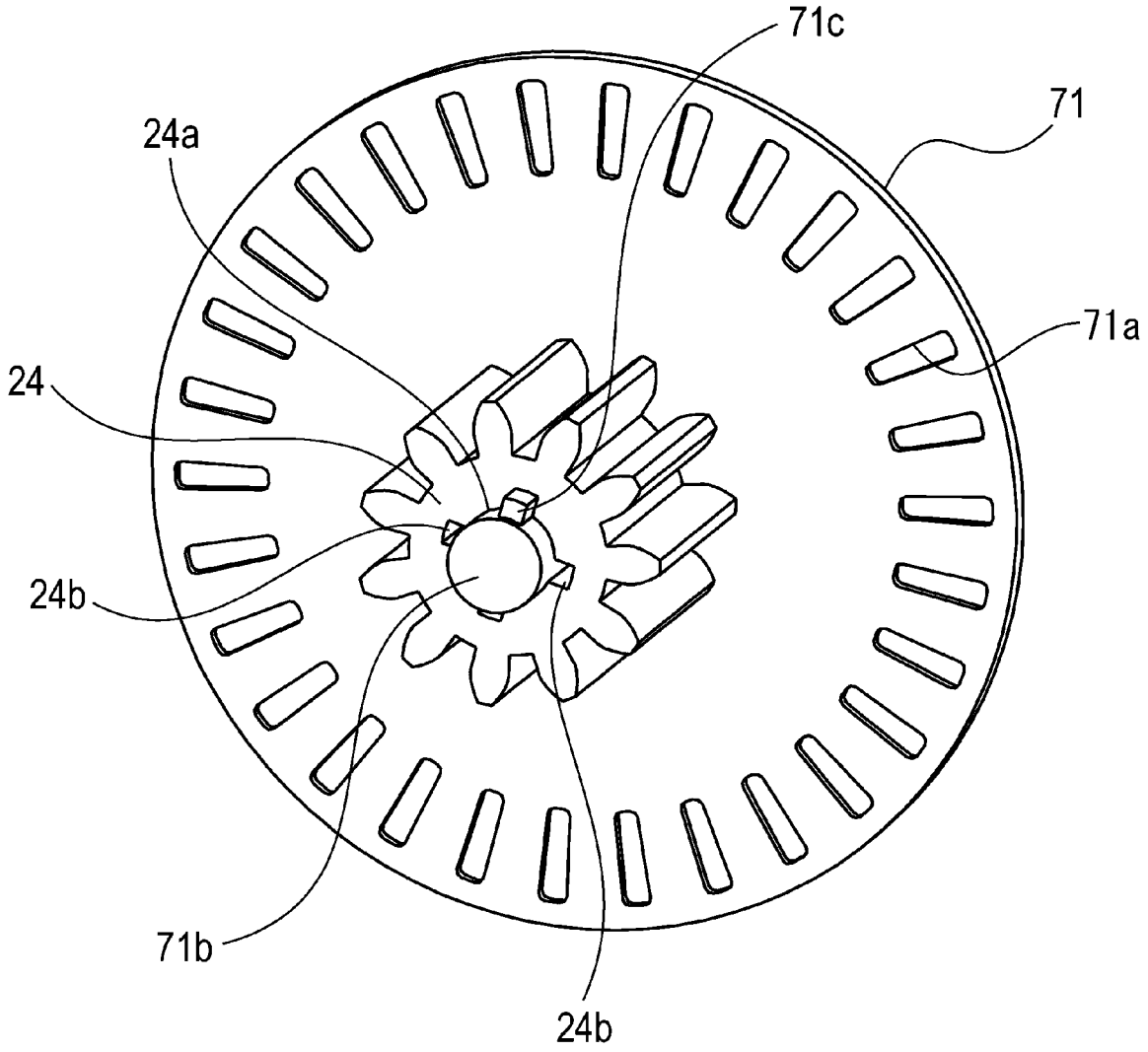

FIG. 8 is a drawing of the combination of the code wheel and rotation detection gear, after the code wheel and rotation detection gear were separately molded and attached to each other.

DESCRIPTION OF THE EMBODIMENTS

The present invention will be described in detail with reference to preferred embodiments of the present invention. However, the measurement, material, and shape of each of the structural components of the image forming apparatus, and the positional relationship among the components, are to be changed according to the structure of the apparatus to which the present invention is applied, and also, various conditions of the apparatus. That is, the following embodiments of the present invention are not intended to limit the present invention in scope.

Embodiment 1

Next, referring to the drawings, a driving device 4 in the first embodiment of the present invention, and an image forming apparatus 1 having the driving device 4, are described. First, the image forming apparatus 1 is described. Then, the driving device 4 is described.

(Image Forming Apparatus)

Referring to parts (a) and (b) of FIG. 2, the image forming apparatus 1 is described about its general structure. Each of parts (a) and (b) of FIG. 2 is a schematic sectional view of the image forming apparatus 1, and shows the general structure of the image forming apparatus 1. Part (b) of FIG. 2 is a schematic sectional view of the image forming apparatus 1, when the delivery tray 51, which was in the state shown in part (a) of FIG. 2, has just been opened to allow a process cartridge 60 to be installed into the apparatus main assembly 2. By the way, the image forming apparatus 1 in FIG. 2 is a laser beam printer, which is an example of image forming apparatus 1.

Referring to parts (a) and (b) of FIG. 2, the main assembly 2 of the image forming apparatus 1 is provided with an image forming portion 3 which forms an image with use of an electrophotographic method, the driving device 4 (FIG. 1) which will be described later, and a sheet feeding apparatus 10 for feeding a sheet S of recording medium into the image forming portion 3. This image forming portion 3 is provided with a photosensitive drum 61 for forming a toner image, a transfer roller 31 which transfers the toner image formed on the photosensitive drum 61, onto the sheet S, a charge roller 62 which uniformly charges the peripheral surface of the photosensitive drum 61, a developing device 63, etc.

By the way, the photosensitive drum 61, which is an image bearing member, is an integral part of the process cartridge 60 which comprises the charge roller 62 and developing device 63, which are means for processing the image bearing member. The image forming apparatus 1 is structured so that the process cartridge 60 is removably installable into the apparatus main assembly 2 in the direction indicated by an arrow mark A in part (b) of FIG. 2.

Next, the image forming operation of the image forming apparatus 1 structured as described above is described. The photosensitive drum 61 is rotated in the direction (clockwise direction) indicated by an arrow mark. As it is rotated, its peripheral surface is uniformly charged by the charge roller 62. The uniformly charged peripheral surface of the photosensitive drum 61 is scanned by (illuminated with) a beam of laser light projected, while being modulated with image signals from an unshown host computer, by a laser scanner 70 with which the apparatus main assembly 2 is provided. As a result, an electrostatic latent image is formed on the peripheral surface of the photosensitive drum 61. The electrostatic latent image formed on the peripheral surface of the photosensitive drum 61 is developed into a toner image, with the use of toner in the developing device 63. Consequently, a toner image is formed on the peripheral surface of the photosensitive drum 61.

Meanwhile, the sheet feeding roller 11 is controlled in such a manner that it rotates in the clockwise direction only when a sheet S of recording medium needs to be fed into the apparatus main assembly 2. It is pressed on the sheet S, and conveys the sheet S with the use of the friction it generates between itself and the sheet S. By the way, if two or more sheets S on a sheet holding plate 13 are simultaneously fed into the apparatus main assembly 2, only the top one is separated from the rest by a separating means 14, and conveyed downstream.

Next, the topmost sheet S separated by the separating means 14 as described above is sent to a registration unit 20, by which it is corrected in attitude, if it is being conveyed askew. Thereafter, the sheet S is sent by the registration unit 20 to a transferring portion 30, which is formed by a combination of the photosensitive drum 61 and transfer roller 31. In the transferring portion 30, the toner image formed on the peripheral surface of the photosensitive drum 61 as described above is transferred onto the sheet S; it is electrically attracted to the sheet S by the transfer roller 31. After the transfer of the toner image onto the sheet S, the sheet S is conveyed by the transferring portion 30, to a fixation unit 40 which comprises a heating unit 41 and a pressure roller 42. In the fixation unit 40, the sheet S and the toner image thereon are heated and pressed. As a result, the toner image becomes fixed to the sheet S. Then, the sheet S is discharged into a delivery tray 51, which is a part of the top surface of the apparatus main assembly 2, by a pair of discharge rollers 50. By the way, the delivery tray 51 is provided with an extension tray 52, which can be extended out of, or retracted into, the delivery tray 50.

(Driving Device)

Figure 1:
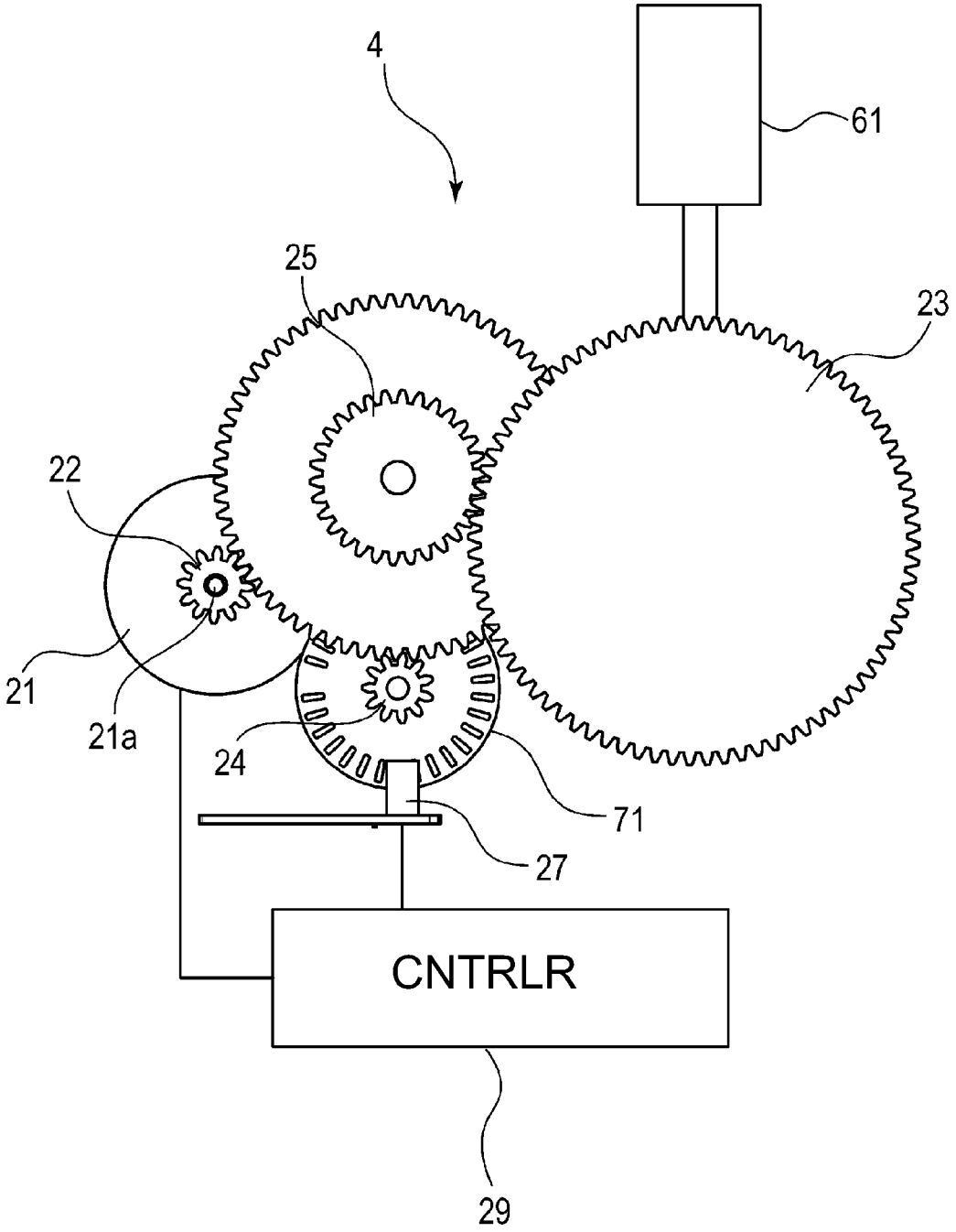
FIG. 1 is a drawing of the driving device in the first embodiment of the present invention; it shows the structure of the apparatus.

Next, referring to FIG. 1, the driving device 4 in the first embodiment of the present invention is described. The aforementioned photosensitive drum 61 is driven by the driving device 4. In the following description of the present invention, the photosensitive drum 61 is described as an example of an object to be driven by the driving device 4. However, this embodiment is not intended to limit the present invention in scope. That is, the member to be rotated by the driving device 4 may be the roller of the fixing apparatus 40, rollers which suspend and tension an endless belt, one of the rollers of the registration unit, or the like.

The driving device 4 has: a motor 21 as the driving force source; a driving gear 22; a photosensitive member gear 23 which drives the photosensitive drum 61: a first idler gear 25 which is in mesh with both the photosensitive member gear 23 and driving gear 22; a code wheel gear 24 which is in mesh with the first idler gear 25; a detecting means 27 (detecting portion); and a controlling means 29 (controlling portion). The photosensitive drum 61 is rotated by the driving force transmitted thereto from the motor 21, by way of the driving gear 22, first idler gear 25, and photosensitive member gear 23.

The driving gear 22 is fixed to the shaft 21*a* of the motor 21. As the methods for fixing the driving gear 22 to the shaft 21*a* of the motor 21, such a method as pressing the shaft 21*a* into the center hole of the driving gear 22 is usable. The photosensitive member gear 23 is concentrically fitted around the shaft of the photosensitive drum 61. It transmits the driving force to the photosensitive drum 61.

The first idler gear 25 is in mesh with both the driving gear 22 and photosensitive member gear 23. It transmits the rotational movement of the driving gear 22 to the photosensitive drum 61, which is the member to be rotated. By the way, in this embodiment, only one gear (first idler gear 25) is employed as the means for transmitting the rotational movement of the driving gear 22 to the photosensitive drum 61 as the member to be rotated. However, this embodiment is not intended to limit the present invention in scope. For example, the present invention is also applicable to a gear train which comprises two or more gears, a driving mechanism which comprises driving force transmitting members such as belts and/or pulleys in addition to the gears. In such a case, the code wheel gear 24 is in mesh with one of these gears.

The code wheel gear 24 is in mesh with the first idler gear 25. Here, by the way, the code wheel gear 24 is in mesh with the first idler gear 25 which transmits the rotational movement of the driving gear 22 to the photosensitive drum 61 which is the member to be rotated, by way of the photosensitive member gear 23. This embodiment, however, is not intended to limit the present invention in scope. That is, the code wheel gear 24 has only to be in mesh with at least one of the gears which transmit the rotational movement of the driving gear 22 to the photosensitive drum 61 which is the member to be rotated. Further, the driving device 4 is structured so that the code wheel gear 24 is subjected to a certain amount of load (torque) to stabilize the code wheel gear 24 in rotational speed. As the means for subjecting the code wheel gear 24 to the load, a spring or the like which generates friction, a torque limiter, or the like can be listed.

The detecting means 27 is for detecting the rotation of the code wheel gear 24. More specifically, it detects a flag as the flag passes by the detecting means 27. The flag is fixed to the code wheel gear 24. In this embodiment, however, the flag is in the form of a code wheel 71. By the way, the flag does not need to be in the form of the code wheel 71. The code wheel gear 24 and code wheel 71 may be molded together. The detecting means 27 is like a photo-interrupter, and has a light emitting element and a light receiving element. It is positioned in such a manner that the code wheel 71 is between the light emitting element and light receiving element, and the light emitted from the light emitting element is detectible by the light receiving element through each of slits 71*a* of the code wheel 71. The detecting means 27 detects the rotation of the code wheel gear 24 by not detecting the light from the light emitting element while the code wheel 71 is blocking the light, or detecting the light which comes through the slits 71*a* of the code wheel 71.

By the way, in this embodiment, the code wheel 71 is constructed so that at least one of the slit intervals is different in width from the rest, in order to enable the detecting means 27 to detect the timing at which computation is to be started for the control of the driving device 4, which will be described later. More specifically, referring to FIG. 1, one of the multiple slits 71*a* of the code wheel 71 is filled (eliminated). Thus, the resultant interval of this section is twice in width compared to the other rest, making it possible to detect the phase (timing) with which the computation is to be started. From the standpoint of improving the driving device 4 in accuracy, the greater it is in the number of the slits of its code wheel 71, the more accurately it can be controlled in speed. Therefore, the smaller it is in the slit interval, the better. From the standpoint of preventing erroneous detection, however, the slit interval has to be greater than the range in which the code wheel 71 fluctuates in rotational speed.

The information detected by the detecting means 27 is sent to the controlling means 29. The controlling means 29 detects the rotation phase (slit interval θn (which will be described later) and angular velocity ω24 (which also will be described later), based on the information from the detecting means 27, and controls the motor 21 in rotational speed so that the motor rotates at a target speed (feedback control).

Next, the control method in this embodiment is described. The object of this embodiment is to minimize the effects of the error in the information obtainable by the detecting means 27, that is, the effect of the code wheel gear 24 and the effect of the error of slits 71*a* of the code wheel 71. Therefore, the controlling means 29 obtains the amount of difference ($fT_{n\cdot i}$) which will be described later) between the value ($fT_{n\cdot i}$) which will be described later) based on the information from the detecting means 27, and the value ($fT_{n\cdot ave}$) which will be described later) which was obtained in advance by measurement. Then, it controls the motor 21, based on the obtained value ($fT_{n\cdot i'}$) to cancel the effect of the code wheel gear 24 and the effect of the error of the slits 71*a* of the code wheel 71. Next, how the effect of the code wheel gear 24, and the effect of the error of the slits 71*a* of the code wheel 71, are cancelled, is described while paying attention to the angular velocity [°/s] of the driving gear 22, angular velocity [°/s] of the code wheel gear 24, and slit interval [°] of the code wheel 71.

The angular velocity $\omega_{22}$ [°/s] of the driving gear 22 is expressible in the form of the following Mathematical Formula 1.

$$\omega_{22}=\omega_{22nominal}+f\omega_{22}\sin(\omega_{22nominal}t) \quad (1)$$

In Mathematical Formula 1 given above, $f\omega_{22}$ [°/s] stands for the amplitude of the change in the angular velocity of the driving gear 22; and $f\omega_{22nominal}$ [°/s], the idealistic value for the angular velocity of the driving gear 22; and t [s] stands for the length of the elapsed time. Further, $f\omega_{22\ sin}(\omega_{22nominal}t)$ [°/s] stands for the variation component of the angular velocity of the driving gear 22, which is in the sinusoidal form. This Mathematical Formula 1 indicates that the change in the speed of the driving gear 22 occurs in synchronism with the rotation period of the driving gear 22, due to the lateral vibration of the shaft of the motor 21 and the eccentricity of the driving gear 22. The reason why the variation component of the driving gear 22 can be expressed in the sinusoidal component is that the inconstancy in the rotation of the driving gear 22 is primarily related to the rotation period of the driving gear 22, and the mathematical formula given above mathematically expresses this relationship.

Further, the angular velocity [°/s] of the code wheel gear 24 is expressed in the form of the following Mathematical Formula 2.

$$\omega_{24}=\omega_{24nominal}+f\omega_{22}\cdot\sin(\omega_{22nominal}t)+f\omega_{24}\cdot\sin(\omega_{24nominal}t+\alpha)\} \quad (2)$$

Up to the n-th slit of the code wheel 71, the amount θn [°] of the interval (which hereafter may be referred to as "slit interval") between the adjacent two slits, which is detected by the detecting means 27 can be expressed in the form of the following Mathematical Formula 3.

$$\theta_n=\theta_{nominal}+f\theta_n \quad (3)$$

In Mathematical Formula 3 given above, $f\theta_n$ [°] stands for the amount of difference between the detected slit interval and the idealistic value for the slit interval, and $\theta_{nominal}$ [°] stands for the idealistic value for the slit interval up to the n-th slit.

Therefore, the length of time $T_{n\cdot1}$ [s] it takes for the n-th slit among the all (Nt) the slits of the code wheel 71 to pass by the detecting means 27 can be expressed in the form of the following Mathematical Formula 4, and the amount $fT_{n\cdot1}$ [s] of difference between the idealistic length of time it should take for the n-th slit to pass by the detecting means 27 and the actually measured length of time ($\theta_{nominal}/\omega_{24nominal}$) it took for the n-th slit to pass by the detecting means 27 can be expressed in the following Mathematical Formula 5.

$$T_{n\cdot1}=\frac{\theta_n}{\omega_{24}}=\frac{\theta_{nominal}+f\theta_n}{\omega_{24nominal}+f\omega_{22}\cdot\sin\left(2\pi\frac{n}{N_t}\right)+f\omega_{24}\cdot\sin\left(2\pi\frac{n}{N_t}+\alpha\right)\}} \quad (4)$$

$$\begin{aligned} fT_{n\cdot1} &= T_{n\cdot1}-\frac{\theta_{nominal}}{\omega_{24nominal}} \\ &= \frac{\theta_{nominal}+f\theta_n}{\omega_{24nominal}+f\omega_{22}\cdot\sin\left(\frac{\omega_{22nominal}}{\omega_{24nominal}}\times2\pi\frac{n}{N_t}\right)+f\omega_{24}\cdot\sin\left(2\pi\frac{n}{N_t}+\alpha\right)\}}-\frac{\theta_{nominal}}{\omega_{24nominal}} \\ &= \frac{\theta_{nominal}+f\theta_n}{\theta_{nominal}\cdot f\omega_{22}\cdot\sin\left(\frac{\omega_{22nominal}}{\omega_{24nominal}}\times2\pi\frac{n}{N_t}\right)+f\omega_{24}\cdot\sin\left(2\pi\frac{n}{N_t}+\alpha\right)\}-\omega_{24nominal}\cdot f\theta_n} \\ &\approx \frac{\theta_{nominal}^2}{\theta_{nominal}\cdot f\omega_{22}\cdot\sin\left(\frac{\omega_{22nominal}}{\omega_{24nominal}}\times2\pi\frac{n}{N_t}\right)+f\omega_{24}\cdot\sin\left(2\pi\frac{n}{N_t}+\alpha\right)\}-\omega_{24nominal}\cdot f\theta_n} \end{aligned} \quad (5)$$

In the mathematical formula given above, $f_{\omega24}$ [°/s] stands for the amplitude of the change in the angular velocity of the code wheel gear 24; $f\omega_{24nominal}$ [°/s], the idealistic value for the angular velocity of the code wheel gear 24; and α [°] stands for the phase difference between the change in the angular velocity of the driving gear 22 and that of the code wheel gear 24. Further, $f\omega_{24\ sin}(\omega_{22nominal}t+\alpha)$ stands for the variation component of the angular velocity of the code wheel gear 24 which is expressed in the sinusoidal form. This mathematical formula indicates that the fluctuation in the speed of the code wheel gear 24 occurs in synchronism with the rotation period of the code wheel gear 24, due to the eccentricity of the code wheel gear 24.

In the mathematical formulas given above, $f\theta_n$ [°] is extremely small compared to $\theta_{nominal}$ [°]. Therefore, $(\theta_{nominal}+f\theta_n)_\theta_{nominal}$. Further, the length $fT_{n\cdot1}$ [s] of time it takes for the n-th slit to pass by the detecting means 27 during the (i+1)-th rotation of the code wheel 71 is expressible in the form of the following Mathematical Formula 6.

$$T_{n\cdot i}=\frac{\theta_n}{\omega_{24}}=\frac{\theta_{nominal}+f\theta_n}{\omega_{24nominal}+f\omega_{22}\cdot\sin\left(\frac{\omega_{22nominal}}{\omega_{24nominal}}\times2\pi\frac{n}{N_t}+\frac{\omega_{22nominal}}{\omega_{24nominal}}\times2i\pi\right)+f\omega_{24}\cdot\sin\left(2\pi\frac{n}{N_t}+\alpha\right)\}} \quad (6)$$

$$fT_{n\cdot i}=\frac{\theta_{nominal}^2}{\theta_{nominal}\cdot f\omega_{22}\cdot\sin\left(\frac{\omega_{22nominal}}{\omega_{24nominal}}\times2\pi\frac{n}{N_t}+\frac{\omega_{22nominal}}{\omega_{24nominal}}\times2i\pi\right)+f\omega_{24}\cdot\sin\left(2\pi\frac{n}{N_t}+\alpha\right)\}-\omega_{24nominal}\cdot f\theta_n} \quad (7)$$

In the case of an ordinary "feedback control", the voltage to be applied to the motor 21 is controlled according to the obtained difference $fT_{n\cdot1}$ [s] (Mathematical Formula 7), to make the rotational speed of the motor 21 close to the target one (idealistic rotational speed). Therefore, if $fT_{n\cdot1}$ [s] contains $f\theta_n$ [°], which is the difference between the detected slit interval and the idealistic value for the slit interval of the code wheel 71, and $f\omega_{24}$ [°/s], which is the amount by which the code wheel gear 24 fluctuate in angular velocity, the motor 21 also is affected in angular velocity by the "feedback control", which in turn undesirably affects the photosensitive drum 61 in rotational speed.

In this embodiment, therefore, the average $T_{n\cdot ave}$ [s] of the length of time it takes for each slit passes by the detecting means 27 while the motor 21 rotates a preset number of times (integer multiple of $Z_{22}$ (tooth count of driving gear 22) is measured. Here, the length of time it takes for a slit to pass by the detecting means 27 means the length of time it takes for each slit of the code wheel 71 to pass by the detecting means 27. The point in time at which the length of time it takes for each slit of the code wheel 71 to pass by the detecting means 27 begins to be measured is the end of the period in which the light receiving element of the detecting means 27 does not detect light for twice the normal length of time the light receiving element does not detect light. That is, the number of times the motor 21 rotates (whether or not motor 21 rotated preset length of times), and the length of time it takes for each slit of the code wheel 71 to pass by the detecting means 27, are measured, and the average $T_{n\cdot ave}$ [s] length of time is calculated for each slit. Then, the difference $fT_{n\cdot ave}$ [s] between the calculated average and idealistic value is calculated. For the sake of simplification, a case in which the motor 21 is rotated by the number of times which is equal to the number of teeth of the driving gear 22 is described (Mathematical Formula 8).

$$fT_{n\cdot ave} = \frac{Z_{22}}{\sum_{i=0}^{Z_{22}} fT_{n\cdot i}} = \frac{\theta_{nominal}^2 \times Z_{22}}{\sum_{i=0}^{Z_{22}-1}\left\{\begin{array}{c}\theta_{nominal}\cdot f\omega_{22}\cdot\sin\left(\frac{\omega_{22nominal}}{\omega_{24nominal}}\times 2\pi\frac{n}{N_t}+\frac{\omega_{22nominal}}{\omega_{24nominal}}\times 2i\pi + f\omega_{24}\cdot\sin\left(2\pi\frac{n}{N_t}+\alpha\right)\right)\\ -\omega_{24nominal}\cdot f\theta_n\end{array}\right\}} \tag{8}$$

In this case, there is no gear (intermediary gear) between the driving gear 22 and code wheel gear 24, and the two gears are the same in meshing frequency. Therefore, the angular velocity $\omega_{22nominal}$ [°/s] of the driving gear 22 is expressible in the following Mathematical Formula 9.

$$\omega_{22nominal} = \omega_{24nominal}\times\frac{Z_{24}}{Z_{22}} \tag{9}$$

$Z_{24}$ in Mathematical Formula 9 stands for the number of teeth of the code wheel gear 24, and $Z_{22}$ stands for the number of teeth of the driving gear 22.

Therefore, $fT_{n\cdot ave}$ [s] is expressible in the form of the following Mathematical Formula 10.

$$fT_{n\cdot ave} = \frac{\theta_{nominal}^2 \times Z_{22}}{\sum_{i=0}^{Z_{22}-1}\left\{\begin{array}{c}\theta_{nominal}\cdot f\omega_{22}\cdot\sin\left(\frac{Z_{24}}{Z_{22}}\times 2\pi\frac{n}{N_t}+\frac{Z_{24}}{Z_{22}}\times 2i\pi\right)+f\omega_{24}\cdot\sin\left(2\pi\frac{n}{N_t}+\alpha\right)\\ -\omega_{24nominal}\cdot f\theta_n\end{array}\right\}} \tag{10}$$

Based on the formula of trigonometrical function, the component of the driving gear 22 is expressible in the form of the following Mathematical Formula 11.

$$\sum_{i=0}^{Z_{22}-1}\sin\left(\frac{Z_{24}}{Z_{22}}\times 2\pi\frac{n}{N_t}+\frac{Z_{24}}{Z_{22}}\times 2i\pi\right) = \frac{\sin\left\{\frac{Z_{22}}{2}\times\frac{Z_{24}}{Z_{22}}\times 2\pi\right\}\times\sin\left(\frac{Z_{24}}{Z_{22}}\times 2\pi\frac{n}{N_t}+\frac{Z_{24}}{Z_{22}}\times\pi\right)}{\sin\left(\frac{Z_{24}}{Z_{22}}\times\pi\right)} = \frac{\sin(Z_{24}\times\pi)\times\sin\left(\frac{Z_{24}}{Z_{22}}\times 2\pi\frac{n}{N_t}+\frac{Z_{24}}{Z_{22}}\times i\pi\right)}{\sin\left(\frac{Z_{24}}{Z_{22}}\pi\right)} = 0 \tag{11}$$

However, with the use of the following Mathematical Formulas 12 and 13, it was possible to eliminate the components related to the driving gear 22 from $fT_{n\cdot ave}$ [s].

$$\sin\left(\frac{Z_{24}}{Z_{22}}\pi\right)\neq 0 \tag{12}$$

$$fT_{n\cdot ave} = \frac{\theta_{nominal}^2\times Z_{22}}{\sum_{i=0}^{Z_{22}}\left\{f\omega_{24}\cdot\sin\left(2\pi\frac{n}{N_t}+\alpha\right)-\omega_{24nominal}\cdot f\theta_n\right\}} = \frac{\theta_{nominal}^2\times Z_{22}}{Z_{22}\left\{f\omega_{24}\cdot\sin\left(2\pi\frac{n}{N_t}+\alpha\right)-\omega_{24nominal}\cdot f\theta_n\right\}}$$

-continued $$= \frac{\theta_{nominal}^2}{\left\{f\omega_{24}\cdot\sin\left(2\pi\frac{n}{N_t}+\alpha\right)-\omega_{24nominal}\cdot f\theta_n\right\}} \tag{13}$$

In this embodiment, $fT_{n\cdot ave}$ [s] is measured in advance, and is inputted, in advance, in the controlling means 29 which is a controller. When the image forming apparatus 1 is actually in use, the motor 21 is controlled in speed based on the value of $fT_{n\cdot i'}$ [s] obtainable by subtracting $fT_{n\cdot ave}$ [s] from the difference $fT_{n\cdot i}$ [s] between the idealistic value for the length of time it takes for each slit to pass by the detecting means 27 and the detected one. $fT_{n\cdot 1'}$ is expressible in the form of the following next Mathematical Formula 14.

$$fT'_{n\cdot i} = fT_{n\cdot i} - fT_{n\cdot ave} = \frac{\theta^2_{nominal}}{\theta_{nominal} \cdot f\omega_{22} \cdot \sin\left(2\pi\frac{n}{N_t} + \frac{\omega_{24nominal}}{\omega_{22nominal}} \times 2i\pi\right)} \quad (14)$$

Therefore, it is possible to control the motor 21 in rotational speed without being affected by the $f\theta n$ [°] which is the difference between the slit interval of the code wheel 71 (which is detected by the detecting means 27) and the idealistic value for the slit interval, and $f\omega_{24}$ [°/s] which is the fluctuation in the angular velocity of the code wheel gear 24.

By the way, unless Mathematical Formula 12 ($\sin(Z_{24}/Z_{22})\neq 0$) is satisfied, Mathematical Formula 11 does not hold. Therefore, the component related to the fluctuation of angular velocity of the motor 21 remains in $fT_{n\cdot ave}$ [S] in Mathematical Formula 13. Therefore, $fT_{n\cdot i'}$ in Mathematical Formula 13 becomes zero ($fT_{n\cdot i'}=0$), making it impossible to control motor 21 in the fluctuation in angular velocity.

The requirement for satisfying Mathematical Formula 12 ($(Z_{24}/Z_{22})\pi\neq 0$) is that the value of $Z_{24}/Z_{22}$) is not an integer, and also, the number of the teeth of code wheel gear 24 does not equal to a value obtainable by multiplying the number of the teeth of the driving gear 22 by an integer.

By the way, in a case where an intermediary gear is between the driving gear 22 and code wheel gear 24, and the driving gear 22 and code wheel gear 24 are not the same in meshing frequency, Mathematical Formula 11 becomes the following Mathematical Formula 15.

//Insert Mathematical Formula 15// (15)

$$\sum_{i=0}^{Z_{22}-1} \sin\left(\frac{\omega_{22nominal}}{\omega_{24nominal}} \times 2\pi\frac{n}{N_t} + \frac{\omega_{22nominal}}{\omega_{24nominal}} \times 2i\pi\right) = \frac{\sin\left(\frac{Z_{22}}{2} \times \frac{\omega_{22nominal}}{\omega_{24nominal}} \times 2\pi\right) \times \sin\left(\frac{\omega_{22nominal}}{\omega_{24nominal}} \times 2\pi\frac{n}{N_t} + \frac{\omega_{22nominal}}{\omega_{24nominal}} \times \pi\right)}{\sin\left(\frac{\omega_{22nominal}}{\omega_{24nominal}} \times \pi\right)} = 0$$

The condition required for Mathematical Formula 15 to hold is that the following Mathematical Formula 16 is satisfied.

$$\sin\left(\frac{Z_{22}}{2} \times \frac{\omega_{22nominal}}{\omega_{24nominal}} \times 2\pi\right) = 0 \text{ and } \sin\left(\frac{\omega_{22nominal}}{\omega_{24nominal}} \times \pi\right) \neq 0 \quad (16)$$

That is, the condition is that in Mathematical Formula 16, the value of $Z_{22}\times(\omega_{22nominal}/\omega_{24nominal})$ is an integer, and the value of $(\omega_{22nominal}/\omega_{24nominal})$ is not an integer. That is, the value of the rotation period of the driving gear 22 is not equal to a value obtainable by multiplying the value of the rotational period of the code wheel gear 24 by an integer, and the value of $Z_{22}\times(\omega_{22nominal}/\omega_{24nominal})$ is an integer. In order for the value of $Z_{22}\times(\omega_{22nominal}/\omega_{24nominal})$ to be an integer, it is necessary to adjust the driving gear 22 in the number of teeth, and also, $(\omega_{22nominal}/\omega_{24nominal})$ which is the inverse of the speed reduction ratio. However, from the standpoint of control accuracy, the number of rotation of the code wheel gear 24 is desired to be higher, and therefore, it is desired that the speed reducing intermediary gear or the like is not placed between the motor 21 and code wheel gear 24.

As described above, in this embodiment, the motor 21 is controlled in rotational speed based on the information from the detecting means 27 so that the motor rotates at a target speed (feedback control). Further, in order to minimize the effect of the lateral vibration of the shaft of the motor 21 and the effect of the eccentricity of the gears, the driving device 4 is structured so that the rotation period of the code wheel gear 24 does not become integer multiple of the rotation period of the driving gear 22. Therefore, it is possible to minimize the image forming apparatus 1 in the inconstancy in the rotational speed of its photosensitive drum which is the object to be rotated. That is, this embodiment can provide an image forming apparatus, which is highly accurate in the rotational speed of its photosensitive drum, and therefore, can output high quality images.

Embodiment 2

Next, the present invention is described with reference to the driving device in the second embodiment of the present invention. In this embodiment, the image forming apparatus 1 is adjusted in the phase of the code wheel gear 24 and flag, and amplitude. As a typical flag, a code wheel can be listed. In the following description of this embodiment, a code wheel is described as an example of the flag. The image forming apparatus in this embodiment is the same in structure and function as the one in the first embodiment, except for the code wheel. Therefore, the image forming apparatus in this embodiment is not described in detail.

In this embodiment, the driving device 4 is structured so that the phase of the rotation period of the error in the slit interval of the code wheel 71, and the cumulative pitch error of the rotation period of the code wheel gear 24 are cancelled. More specifically, the code wheel 71 is adjusted in slit interval so that the cumulative pitch error of the code wheel gear 24 is cancelled. There are two parameters in which the slit interval is adjusted, which are amplitude and phase. Regarding the amplitude, the driving device 4 is structured so that the amount of the cumulative pitch error and the amount of error of the slit interval become as close as possible in amplitude to each other. As for the phase, the image forming apparatus is structured so that the difference in phase between the cumulative pitch error of the code wheel gear 24 and the slit interval of the code wheel 71 become equal to an angle $\alpha$ shown in FIG. 3. The angle $\alpha$ shown in FIG. 3 is the angle between the straight line (which coincides with the rotational axis of the code wheel gear 24, and the rotational axis of the first idler gear 25 which is the intermediary gear between the code wheel gear 24 and photosensitive member gear 23), and the straight line which coincides with the rotational axis of the code wheel gear 24, and the reading point of the detecting means 27. By setting the phase as described above, as the code wheel gear 24 fluctuates in speed at the point at which it is in mesh with the first idler gear 25, the change occurs to slit interval of the code wheel 71, which is detected by the detecting means 27. Therefore, it is possible to prevent the photosensitive member from being made to fluctuate in rotational speed by the eccentricity of the code wheel gear 24. FIGS. 4 and 5 show the effects of this embodiment in the form of a graph.

Shown in FIG. 4 are the lengths of time it took for one of the slit of the code wheel 71 to pass by the detecting means 27 when the phase of the rotation period of the error in the slit interval of the code wheel 71 is inverse to the phase of cumulative pitch error of the rotation period of the code wheel gear 24. In part (a) of FIG. 4, an axis y, or the vertical axis, represents the error ratio [%] of the slit interval. of the code wheel 71, and an axis x, or the horizontal axis, represents the phase [°] of the slit. Part (a) of FIG. 4 shows the slit interval at each phase of the slit 71*a* of the code wheel 71 when the point of detection by the detecting means 27 is a point 0 on axis x. In part (b) of FIG. 4, an axis y, or the vertical axis, represents the amount [mm] of the eccentricity of the code wheel gear 24, and an axis x, or the horizontal axis, represents the phase [°] of the code wheel gear 24. Part (b) of FIG. 4 shows the amount of eccentricity of the code wheel gear 24 at each phase of the code wheel gear 24, which is the intermediary gear between the code wheel gear 24 and photosensitive member gear 23 when the point of meshing between the code wheel gear 24 and the intermediary gear (first idler gear 25) is the point 0 on the axis x. In part (c) of FIG. 4, an axis y, or the vertical axis, represents the length [s] of time it took for one of the slits of the code wheel 71 to pass by the detecting means 27, and the axis x, or the horizontal axis, represents the phase [°] of the slit. Part (c) of FIG. 4 indicates the length of time it takes for one of the slits of the code wheel 71 to pass by the detecting means 27 at each phase. It is assumed here for the sake of simplification that the angular velocity of the motor 21, etc., has little effect in this case. It is desired here that the code wheel gear 24 does not affect the detecting means 27 in performance. However, the eccentricity of the code wheel gear 24 shown in part (b) of FIG. 4 is inverse in phase from the slit interval of the code wheel 71 shown in part (a) of FIG. 4. Therefore, the phase of the rotation period of error in the slit interval of the code wheel 71, and the cumulative pitch error of the rotation period of the code wheel gear 24, are amplified, appearing substantially larger as shown in part (c) of FIG. 4.

FIG. 5 shows the length of time it took for one of the slit of the code wheel 71 to pass by the detecting means 27 when the rotation period of the error of the slit interval of the code wheel 71 and the eccentricity of the rotation period of the code wheel gear 24 became the same in phase. In part (a) of FIG. 5, an axis y, or the vertical axis, represents the error ratio [%] of the slit interval of the code wheel 71, and an axis x, or the horizontal axis, represents the phase [°] of the slit. Part (a) of FIG. 5 shows the slit interval at each phase of the slit 71*a* of the code wheel 71 when the point of detection by the detecting means 27 is a point 0 on axis x. In part (b) of FIG. 5, the axis y, or the vertical axis, represents the amount [mm] of the eccentricity of the code wheel gear 24. And the axis x, or the horizontal axis represents the phase [°] of the code wheel gear 24. Part (b) of FIG. 5 shows the amount [mm] of eccentricity of the code wheel gear 24 at each phase of the code wheel gear 24 when the point of meshing between the code wheel gear 24 and the intermediary gear (first idler gear 25) is the point 0 on the axis x. In part (c) of FIG. 5, an axis y, or the vertical axis, represents the length [s] of time it took for one of the slits of the code wheel 71 to pass by the detecting means 27, and the axis x, or the horizontal axis, represents the phase [°] of the slit. Part (c) of FIG. 5 indicates the length of time it took for one of the slits of the code wheel 71 to pass by the detecting means 27 at each phase. It is assumed here for the sake of simplification that the angular velocity of the motor 21, etc., has little effect in this case. Regarding the detecting means 27, the amount of the eccentricity of the code wheel gear 24, shown in part (b) of FIG. 5, and the slit interval of the code wheel 71, show in part (c) of FIG. 5, are the same in phase. Therefore, the phase of the rotation period of error in the slit interval of the code wheel 71, and the cumulative pitch error of the rotation period of the code wheel gear 24, are cancelled, making it possible to substantially reduce the effect of the code wheel gear 24 and code wheel 71.

Next, a method for adjusting the slit interval of the code wheel 71 to cancel the cumulative pitch error of the code wheel gear 24 is described. It is thinkable to mold the code wheel 71 and code wheel gear 24 together, or separately mold the code wheel 71 and code wheel gear 24 and put them together later.

Next, referring to FIG. 6, a case in which the code wheel 71 and code wheel gear 24 are molded together is described. The mold, in which the code wheel 71 and code wheel gear 24 are molded together, is adjusted in the slit interval of the code wheel 71, and the phase and amplitude of the cumulative pitch error of the code wheel gear 24. The actual process is as follows: After the completion of the molding for the combination of the code wheel gear 24 and code wheel 71, the mold is measured in the cumulative pitch error of the code wheel gear 24. Then, the mold is modified so that the slit interval of the code wheel 71 becomes the same in value as the value of the amplitude of the cumulative pitch error of the code wheel gear 24, but different in phase (angle $\alpha$ shown in FIG. 3) from the code wheel gear 24. As for a method for forming the mold as described above, it is thinkable to minutely adjust the mold in slit interval, or to form the mold so that the center of the code wheel 71 is slightly offset from that of the code wheel gear 24. In the case of the method in which the center of the code wheel 71 is slightly offset from that of the code wheel gear 24, it is possible to make the code wheel 71 and code wheel gear 24 the same in phase and amplitude by controlling the amount by which the centers are offset from each other, and the direction in which the centers are offset from each other.

Next, a case in which the code wheel 71 and code wheel gear 24 are separately molded is described. Even in a case where the code wheel 71 and code wheel gear 24 are separately molded, the mold is adjusted in the slit interval of the code wheel 71, and the phase and amplitude of the cumulative pitch error of the code wheel gear 24. One of the methods is as follows: After the molding of the code wheel 71 and code wheel gear 24, the code wheel gear 24 is measured in the cumulative pitch error. Then, the mold is modified so that the slit interval of the code wheel 71 becomes the same as the as the amplitude of the measured cumulative pitch error, and has the phase difference (angle $\alpha$ in FIG. 3). However, in a case two or more molds are used, it is very difficult to adjust them. Therefore, a method for adjusting the molds in the slit interval so that the aforementioned phase and amplitude are obtained is described.

To begin with, the first method is described with reference to FIGS. 7 and 8. Referring to FIG. 7, either the code wheel gear 24 or code wheel 71 is provided with two or more driving force transmitting portions as shown in FIG. 7, and the other is provided with such driving force transmitting portions that can be selectively engaged with one of the first driving force transmitting portions, the other being smaller in the number of the driving force transmitting portions. In the case of the code wheel 71 and code wheel gear 24 shown in FIG. 7, the code wheel 71 is provided with a shaft 71*b* having one driving force transmitting portion 71*c* which radially protrudes from the circumferential surface of the shaft 71*b* and can be engaged with the code wheel gear 24. As for the code wheel gear 24, it is provided with a hole 24*a*, through which the aforementioned shaft 71*b* can be fitted. Further, it is provided with four driving force transmitting portions 24*b*, in which the driving force transmitting portion 71*c* can be fitted. Then, the code wheel 71 and code wheel gear 24 are put together in such a manner that the driving force transmitting portion 71*c* of the code wheel 71 fits into one of the four driving force transmitting portions 24*b* (FIG. 8), which makes the difference between the error in the cumulative pitch, and the phase difference of the slit interval of the code wheel 71, as close as the angle α (FIG. 3). This method, however, can control only the phase; it cannot control the amplitude. Regarding the phase, in the case of the code wheel 71 and code wheel gear 24 shown in FIG. 7, the code wheel 71 and code wheel gear 24 can be adjust in phase by an increment of ¼ of turn. In a case where the code wheel 71 and code wheel gear 24 is separately molded, if it is desired to adjust the code wheel 71 and code wheel gear 24 in phase at a higher level of accuracy, the side which is provided with two or more driving force transmitting portion has only to be increased in the number of the driving force transmitting portion as necessary.

By the way, it is not mandatory that the driving force transmitting portions are shaped as shown in FIGS. 7 and 8. For example, it may be shaped so that it is D-shaped in cross-section. As another method for more precisely control the code wheel 71 and code wheel gear 24 in the phase and amplitude of eccentricity, it is thinkable to provide a play between the wall of the hole, and the shaft so that the code wheel 71 and code wheel gear 24 can be adjusted in the phase and amount of eccentricity. As a means for fixing the code wheel 71 and code wheel gear 24 to each other, small screws, welding, gluing, etc, which can ensure that the code wheel 71 and code wheel gear 24 rotate together.

As described above, this embodiment also can reduce the driving device 4 in inconstancy in the rotational speed of the member to be rotated, by reducing the driving device 4 in the effect of the lateral shaking of the motor shaft, and the effect of the eccentricity of gears. Further, it makes it possible to provide an image forming apparatus which is low in cost, and yet, highly accurate in the rotational speed of its photosensitive drum, and therefore, can output high quality images.

(Miscellanies)

In the embodiments described above, the image forming apparatus 1 was a monochromatic image forming apparatus which has only one photosensitive drum 61. These embodiments, however, are not intended to limit the present invention in scope. That is, the present invention is also applicable to a color image forming apparatus of the so-called rotary type, in which multiple developing devices are selectively made to oppose a single photosensitive drum. Further, it is also applicable to an image forming apparatus which has a sheet bearing member, and is structured so that multiple toner images, which are different in color, are sequentially transferred in layers onto a sheet of recording medium on the sheet bearing member. Further, it is also applicable to a color image forming apparatus which has an intermediary transferring member, sequentially transfers multiple toner images, which are different in color, in layers onto the intermediary transferring member, and transfers the toner images on the intermediary transfer images onto a sheet of recording medium all at once.

Further, in the embodiments described above, the process cartridge which is removably installable in the main assembly of the image forming apparatus was such a process cartridge that has a photosensitive drum, and processing means, for example, a charging means, a developing means, etc., for processing the photosensitive drum. These embodiments was not intended to limit the present invention in scope. For example, the present invention is also compatible with such a process cartridge that has one of the charging means, a developing means, and cleaning means, in addition to a photosensitive member. Moreover, in the embodiments described above, the image forming apparatus was structured so that a process cartridge which comprises a photosensitive member is removably installable. These embodiments, however, were not intended to limit the present invention in scope. For example, the present invention is also applicable to an image forming apparatus structured so that its photosensitive drum, and its processing means for processing the photosensitive drum, are integral parts of the image forming apparatus, or an image forming apparatus structured so that its photosensitive drum, and its processing means for processing the photosensitive drum, are separately and removably installable in its main assembly.

Further, in the embodiments described above, the image forming apparatus was a printer. These embodiments, however, was not intended to limit the present invention in scope. That is, the present invention is also applicable to image forming apparatuses other than those in the preceding embodiment. For example, it is applicable to a copying machine, a facsimileing machine, or a multifunction machine capable of functioning as a copying machine, a facsimileing machine, etc. The application of the present invention to these image forming apparatuses can provide the same effects as those provided by the preceding embodiments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-124665 filed on Jul. 3, 2019, which is hereby incorporated by reference herein in its entirety.

What is claimed is:

1. A driving device for driving a driven member, said driving device comprising:

a driving source;

a driving gear fixed to a rotation shaft of said driving source;

at least one gear configured to transmit rotational motion of said driving gear to the driven member;

a rotation detection gear engaged with said at least one gear;

a detector configured to detect rotation of said rotation detection gear; and a controller configured to detect an angular speed and a rotational phase of said rotation detection gear on the basis of information from said detector and to control the rotational speed of said driving source, wherein a rotation period of said rotation detection gear is a non-integer multiple of a rotation period of said driving gear.

2. A driving device according to claim 1, further comprising a flag rotatable together with said rotation detection gear, wherein said detector detects the rotation of said rotation detection gear by detecting said flag.

3. A driving device according to claim 2, wherein said flag is a code wheel including a plurality of slits arranged in a rotational direction, wherein an interval between adjacent slits at least one portion is different from the other intervals between adjacent slits, and said detector detects the rotation of the rotation detection gear by detecting said slits of said code wheel.

4. A driving device according to claim 3, wherein a phase of said flag and the phase of said rotation detection gear are determined such that a phase difference between a cumulative pitch error of said rotation detection gear and a slit interval of said code wheel is the same as an angle between a line connecting a center of said rotation detection gear and an engaging position between said rotation detection gear and said at least one gear and a line connecting the center of said to rotation detection gear and a detecting position of said detector.

5. A driving device according to claim 4, wherein said flag and said rotation detection gear are integrally formed.

6. A driving device according to claim 4, wherein said flag and said rotation detection gear are formed as separate members, wherein one of said flag and said rotation detection gear is provided with a number of first drive transmitting portions, and the other is provided with a smaller number of second drive transmitting portions selectively engageable with one of said first drive transmitting portions, and wherein one of said first drive transmitting portions is engaged with one of said second drive transmitting portions is selectively engaged with each other, so that said flag and said rotation detection gear are unified.

7. A driving device according to claim 3, wherein a difference between an average of passing time of each slit of said code wheel and an ideal slit passing time is pre-measured, and said controller executes a feedback control such that a rotational speed of said driving source is a target speed, on the basis of a value obtained by subtracting the pre-measured time difference from a difference between the slit passing time in operation and the ideal slit passing time.

8. An image forming apparatus comprising:

a rotatable member; and a driving device according to claim 1, configured to rotate said rotatable member.

* * * * *